US006612948B1

(12) United States Patent
Miller

(10) Patent No.: US 6,612,948 B1
(45) Date of Patent: Sep. 2, 2003

(54) NON-SLIP INFLATABLE SPORTS BALL

(76) Inventor: Arthur Miller, 1 Commercial Ct., Plainview, NY (US) 11803

( * ) Notice: Subject to any disclaimer, the term of this patent is extended or adjusted under 35 U.S.C. 154(b) by 0 days.

(21) Appl. No.: 10/138,669

(22) Filed: May 6, 2002

(51) Int. Cl.[7] ..... K63B 41/08
(52) U.S. Cl. ..... 473/596
(58) Field of Search ..... 473/596, 595, 473/604, 605, 597, 603, 614, 573

(56) References Cited

U.S. PATENT DOCUMENTS 2,931,653 A * 4/1960 Gow et al. ..... 473/596
3,256,019 A * 6/1966 Barton ..... 473/597
4,570,931 A * 2/1986 Martin ..... 473/596
4,991,842 A * 2/1991 Finley ..... 473/596
5,433,438 A * 7/1995 Gilman ..... 473/596
5,577,732 A * 11/1996 Spector ..... 473/576
5,735,761 A * 4/1998 Palmquist ..... 473/596
6,024,661 A * 2/2000 Guenther et al. ..... 473/605

* cited by examiner

*Primary Examiner*—Steven Wong
(74) *Attorney, Agent, or Firm*—Myron Amer P.C.

(57) ABSTRACT

An external surface to enhance the catching of an inflated sports ball which is imparted with a frictioned nature when caught in flight and is caused by a molded surface of a plurality of hollow raised circular 3/16 inch projections which collapse under the external pressure of closing movement exerted thereagainst in the catching of the sports ball, wherein the collapsed projections obviate slippage along the external surface.

3 Claims, 1 Drawing Sheet

NON-SLIP INFLATABLE SPORTS BALL

The present invention relates generally to a play value-enhancing improvement for an inflatable sports ball in which, more particularly, the improvement is an external surface that in response to the manner in which it is handled during use exceeds beyond its construction an added frictional nature and texture rendering the sports ball easier to catch.

EXAMPLES OF THE PRIOR ART

For inflatable sports balls that in use are thrown and caught to provide their play value, there is documented in the patented literature the use of external surfaces, consisting in one example of recesses and in contrast in another example raised projections, according to U.S. Pat. No. 4,000,894 for "Game Ball" issued to Kenneth B. Butzen on Jan. 4, 1977, and U.S. Pat. No. 2,931,653 for "Footballs Having a Securely Grippable Laceless Surface issued to A. R. Gow et al. on Apr. 5, 1960. The external surfaces are thus of a desired frictional nature or texture as molded, i.e., using a relatively expensive cavity mold and its attendant demanding technology.

Broadly, it is an object of the present invention to overcome the foregoing molding expense and other shortcomings of the prior art, while nevertheless achieving for play value end use a non-slip or readily catchable sports ball external surface.

More particularly, it is an object of the present invention to use to advantage the manner in which the sports ball is handled when caught to modify its eternal surface, molded by less expensive vacuum molds and applicable technology, into an equivalent of the cavity-molded friction surface, and thus providing comparable noteworthy play value.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
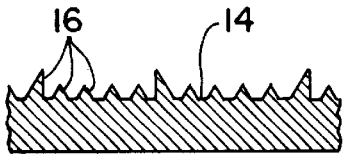
FIG.1 PRIOR ART
FIGS. 1 and 2 are partial cross-sectional views of profiles of prior art surfaces of sports balls.
Figure 2:
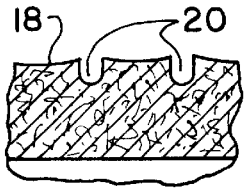
FIG.2 PRIOR ART
Figure 7:
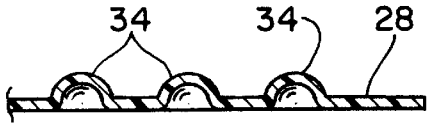
FIG. 7 is a plan view of a detail view in section taken along line 7—7 of FIG. 6.
Figure 10:
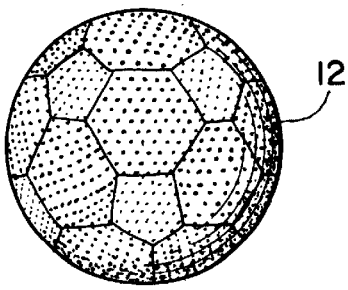
FIG. 10 is a view similar to FIG. 3, but of a sports ball in a soccer ball configuration.
Figure 3:
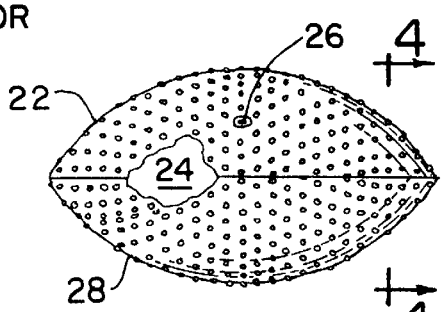
FIG. 3 is a side view of a sport ball in a football configuration having an exterior surface in accordance with the present invention.
Figure 8:
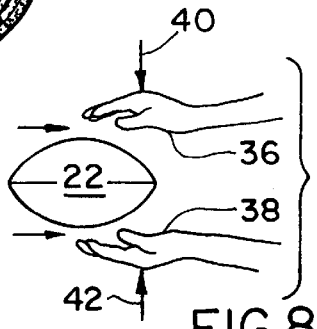
FIG. 8 is a schematic view illustrating a use of the FIG. 3 football.
Figure 9:
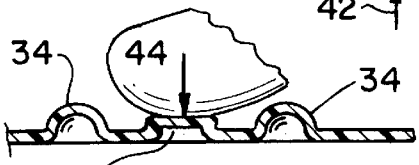
FIG. 9 is a detail view, similar to FIG. 7, and illustrating a consequence of the FIG. 8 use.
Figure 4:
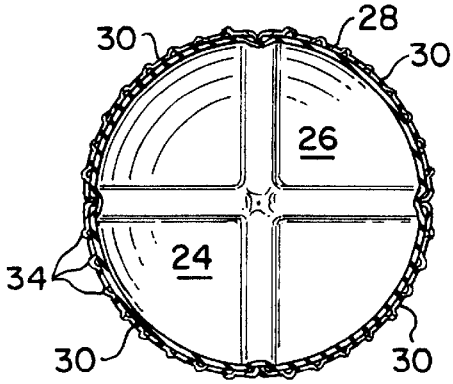
FIG. 4 is a sectional view, taken along line 4—4 of FIG. 3.
Figure 5:
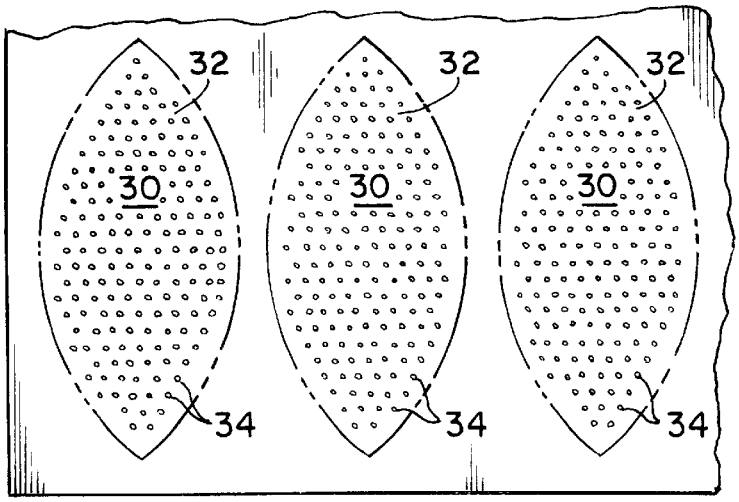
FIG. 5 is a plan view of vacuum molded components of the football of FIG. 3.
Figure 6:
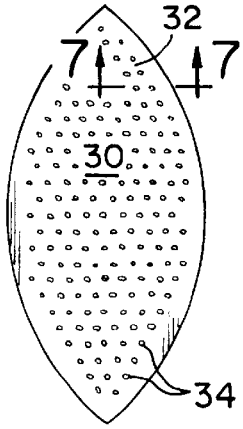
FIG. 6 is a plan view of a die cut component of the components of FIG. 5.

It is known by common experience, as well as documented in the prior patented literature that an inflatable sports ball, such as a football and, to a lesser extent a soccer ball, has greater play value if it has an external surface treatment that renders it more readily catchable. Thus, as in U.S. Pat. No. 2,931,653 for "Footballs Having a Securely Grippable Laceless Surface" issued to A. R. Gow et al. on Apr. 5, 1960, the external plastic surface 14 of the inflated football is molded with a plurality of spaced-apart hand grippable projections, individually and collectively designated 16, and, to the same end but in a contrasting approach, in U.S. Pat. No. 4,000,894 for "Game Ball" issued to Kenneth B. Butzen on Jan. 4, 1977, the external plastic surface 18 of the inflated game ball is molded with a plurality of spaced-apart hand-grippable recesses, also individually and collectively designated 20. While eschewing a non-smooth and thus hand-grippable external surface 14, 18 the inability of the user failing in an attempt to catch the thrown objects is lessened, but the drawback of the '653, '894 patents is the relatively high cost of machining the cavity molds necessary to produce the recesses 20 and projections 16.

Underlying the present invention is the recognition that by using to advantage the manner in which the inflated object is handled while it is being caught, that as a substitution for a cavity mold and its attendant technology use can be made of a vacuum mold and its less demanding parameters to embody the inflatable object with a friction or hand-grippable exterior surface, all as will be better understood as the description proceeds.

More particularly, internally the within inventive inflatable football 22 has a bladder 24 which is inflated with pressure air, as noted at 26, which provides the football shape. A cover 28 of plastic construction material, such as vinyl, in a thin gauge (e.g., 0.037 inches) is disposed, in a well known manner in encircling relation about the bladder 24, in plural molded geometric shapes, initially molded as a flat sheet and subsequently die cut into the illustrated geometric shapes. The molding fabrication using a vacuum mold as generally known, contemplates imparting into the plastic a molded pattern generally designated 32, of plural forwardly facing hollow semi-circular projections, individually and collectively designated 34, each of a diameter of approximately 3/16 of an inch.

During use of the football 22, a child's hands 36 and 38 partakes of opposite directional closing movements 40 and 42 upon the football 22 in flight to effectuate a successful catching maneuver. As a consequence, the hollow projections 34 flatten under the applied force 44 of the closing movements 40, 42, and assume the modified condition, as noted at 46, which in practice enhances the catching of the football 22, as well as the catching of a soccer ball 12 by a soccer goal tender.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A sports ball of a selected shape having play value for a child incident to being caught by opposite directional closing movements of said child's hands thereupon, said sports ball comprising an inflatable bladder, pressure air within said bladder of an extent exerting an outwardly directional force to both impart a three dimensional inflated shape thereto and oppose deformation of said bladder as might result from an inwardly applied directional force, thin gauge plastic construction material disposed with delineated areas in a flat relation as a cover against said bladder and having a pattern of molded outwardly facing hollow circular projections each of a diameter of approximately 3/16 of an inch and in a clearance position above said delineated areas a child's hands partaking of opposite directional closing movements upon said sports ball in flight during the sports activity use thereof effective to flatten between said bladder and said flat delineated cover areas, said hollow projections in collapsed configurations in response to an applied force of closing movements applied thereagainst during the catching of said sports ball, whereby said collapsed configurations enhance the gripping of said sports ball.

2. The sports ball of claim 1 wherein the selected shape thereof is of a football.

3. The sports ball of claim 1 wherein the selected shape thereof is of a soccer ball.

* * * * *